United States Patent [19]

Petterson

[11] Patent Number: 4,578,923

[45] Date of Patent: Apr. 1, 1986

[54] REVOLVING PLATFORM FOR LOAD MATERIAL

[76] Inventor: Kent G. Petterson, 25, Violvägen, S-198 00 Bålsta, Sweden

[21] Appl. No.: 455,843

[22] Filed: Jan. 5, 1983

[30] Foreign Application Priority Data

Jan. 19, 1982 [DE] Fed. Rep. of Germany ..... 3201355

[51] Int. Cl.[4] ..... B65B 11/04

[52] U.S. Cl. ..... 53/211; 53/556; 53/587; 414/754

[58] Field of Search ..... 53/556, 211, 587, 214, 53/465, 441; 414/608, 757, 754, 223, DIG. 911

[56] References Cited

U.S. PATENT DOCUMENTS 4,281,500 8/1981 Mueller et al. ..... 53/211

FOREIGN PATENT DOCUMENTS 657932 9/1951 United Kingdom .
763420 12/1956 United Kingdom .
903439 8/1962 United Kingdom .
1431522 4/1976 United Kingdom .
2056401 3/1981 United Kingdom ..... 53/556

*Primary Examiner*—Leonidas Vlachos
*Assistant Examiner*—Jerry Kearns
*Attorney, Agent, or Firm*—Shapiro and Shapiro

[57] ABSTRACT

The present invention relates to a revolving platform for load material, which is a platform of low height mounted on the ground and revolving about its center, said platform being provided with a recess, extending from the edge of the platform, for the fork arms of a fork lift truck or the like.

6 Claims, 2 Drawing Figures

REVOLVING PLATFORM FOR LOAD MATERIAL

The present invention relates to a revolving platform for load material, which is primarily intended for use in packing the material loaded on it by means of shrink or stretch film of plastics or like material.

This permits handling the packing material at a fixed station, the load material being revolved relative to this station. This is of particular importance in treating with shrink film, because the heating units used for this purpose include hoses which are difficult to handle and are easily damaged and not fit for being moved around the load material.

New and characteristic of the revolving platform according to the invention is that it is a platform of low height mounted on the ground and revolving about its centre, said platform being provided with a recess extending from the edge of the platform, for the fork arms of a fork lift truck or the like, and allowing the forks, while leaning against the ground, to enter into the platform in such manner that a load placed on the fork arms can be deposited on the platform. This revolving platform can simply be mounted directly on a concrete floor or the like, there being no obstacle whatsoever to prevent the fork arms from leaning against the ground, usually by means of wheels. Thus the fork arms can be pushed without resistance into the recess of the platform for depositing and collecting the load material.

The invention will be described more particularly with reference to the accompanying drawing which shows by way of example an embodiment of the revolving platform and in which.

Figure 1:
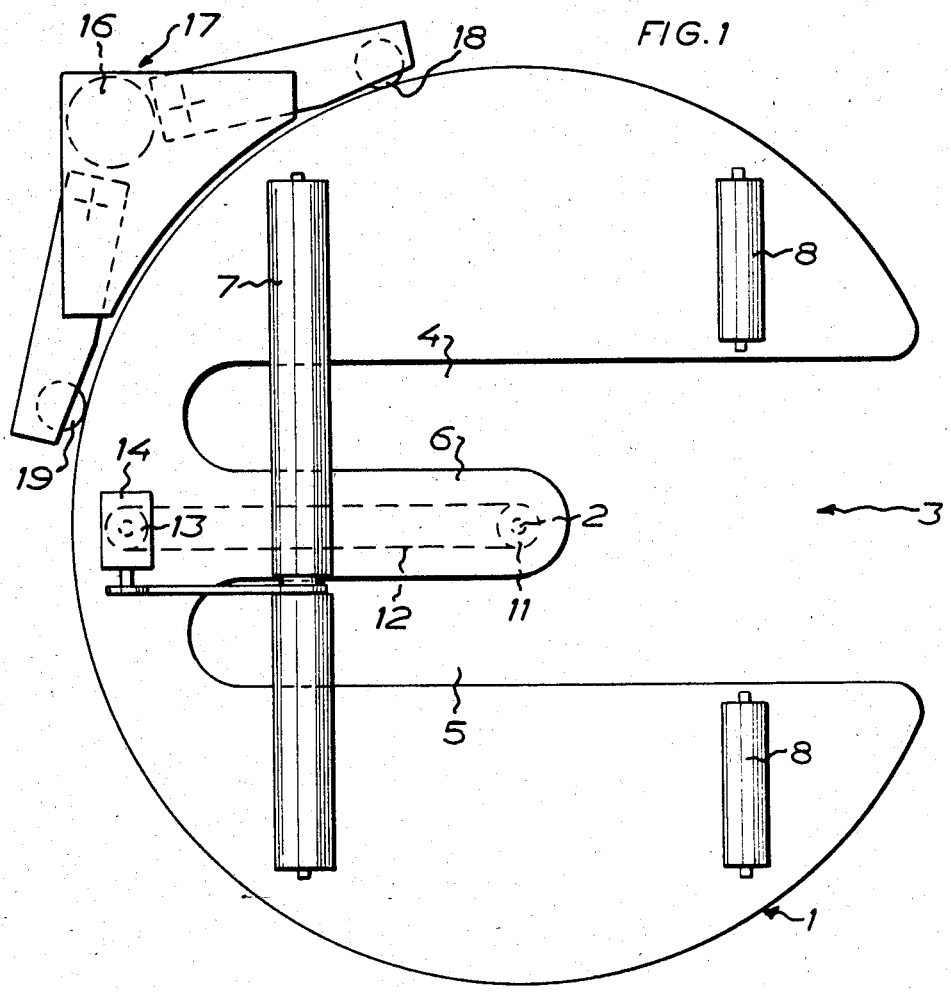
FIG. 1 is a top view of the platform.
Figure 2:
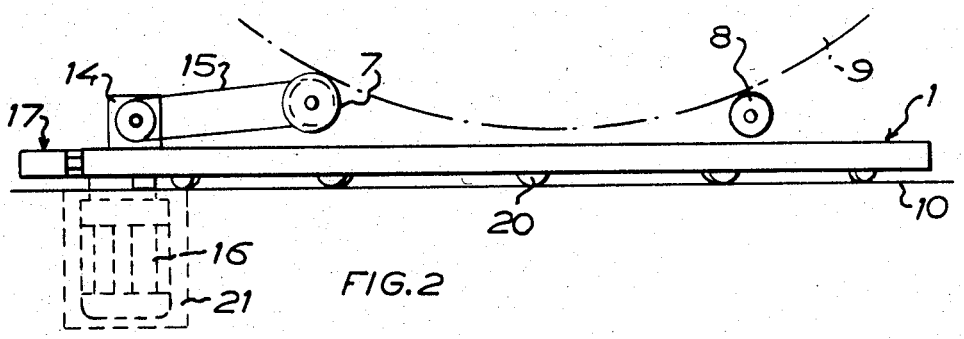
FIG. 2 is a side view of it.

The platform 1 is a platform of low height which is mounted on the ground for pivoting about its centre 2. The platform 1 is provided with a recess 3 extending from the edge of the platform, for the fork arms of a fork lift truck or the like, and allowing the forks, while leaning against the ground, to enter into the platform 1 in such manner that a load placed on the fork arms can be deposited on the platform 1.

The recess 3 extending from the edge is generally in the form of a U having its legs 4 and 5 situated on either side of, and extending past the centre 2 of the platform 1, while the portion 6 between the legs 4 and 5 comprises the centre 2 of the platform 1, which centre is provided with the bearing for the platform 1. The bearing suitably includes a pivot pin arranged on a plate which is secured by means of some bolts to the ground which consists e.g. of a concrete floor.

The platform 1 may of course itself serve as a ground for the load material to be packed, said load material being suitably placed on a pallet. In the embodiment shown, however, the platform 1 is provided with a pair of rollers 7 and 8 for supporting the load 9 which, in that case, is to be cylindrical in shape, such as rolls of paper and the like. The rollers 7 and 8 are parallel with each other and arranged transversely of the recess 3 in the platform 1, one roller 7 being situated inside the centre 2 of the platform 1 while the other roller 8 is situated outside the centre 2 of the platform 1. To permit the fork arms to pass into the platform 1 with the load 9, the roller 8 is composed of two parts situated each on one side of the recess 3. The outer roller 8 is lower than the inner roller 7. The outer roller 8 thus allows the load 9 to pass over it while the inner roller 7 serves as a stop for the load when this is introduced on the platform 1. Besides, the distance of the outer roller 8 from the inner roller 7 should be adjustable.

During the packing operation the cylindrical load 9 resting on the rollers 7 and 8 should turn through a certain angle while the platform 1 completes a revolution. One of the rollers 7 and 8 therefore is driven. It is preferably the roller 7 that is driven, the relative movement of the platform 1 and the ground 10 being utilized for the driving operation. According to the drawing the fixed pin, about which the platform 1 revolves, is provided with a chain wheel 11 which, via a chain 12, cooperates with a chain wheel 13 mounted in the platform 1 and driving, via a gear 14, a chain 15 which, again, drives the roller 7. In this connection the gear ratio is so chosen that the cylindrical load 9 turns through a desired angle while the platform 1 completes one revolution.

In the preferred embodiment the platform 1 is of circular shape and preferably it is so large that pallets and cylindrical loads 9 can be situated inside the periphery thereof. This eliminates the risk of the packing operator being hurt by protruding parts. The circular shape also has the effect that the platform 1 is easily driven by means of the motor 16. Thus the platform 1 is provided with a driving unit 17 coacting with the periphery of the circular platform 1 and formed so as to bridge the portion of the recess 3 situated on the periphery.

The driving unit 17 includes two spaced-apart wheels 18 and 19, gear wheels or the like, driven by the motor 16 and coacting with the periphery of the circular platform 1. This can quite simply consist of a sheet metal band set up edgewise, with or without rubber covering. It may also be formed with teeth or with a chain for the engagement of the gear wheels.

The platform 1 consists of a relatively thin metal sheet which is provided on its underside with reinforcement beams. These are so arranged that wheels 20 for supporting the platform 1 can be mounted on their underside. The wheels 20, which are situated adjacent the periphery of the platform 1, but also could be situated adjacent the recess in the platform 1, consist of cylindrical rolls. These rolls 20 are mounted on radially directed axles which are slightly inclined in downward-inward direction towards the centre 2 of the platform 1. The inclination is so chosen that the rolls 20, after driving in, effect a rolling motion without slipping.

The driving unit 17, like the centre pin, is fitted in a plate which is secured to the floor by means of some bolts. More exactly, the driving unit 17 is so arranged that it is situated altogether below the loading plane of the platform 1 so that outstanding load is not obstructed by it. According to the drawing the motor 16 thus is placed in a recess 21 in the floor 10.

When the packing operation is completed the platform 1 should be turned so that the load can be easily collected by the fork lift truck or the like. For this purpose the platform 1 coacts at its periphery with a preferably semi-protected contact with adjustable time relay by means of which the platform 1 can be brought to stop in the desired position of turning.

The turning movement required for the packing operation proper is to be initiated by a pedal or the like, which is adapted in such a way that the turning movement is immediately interrupted when the pedal action ceases. Thus the operator does not risk being hurt if he for some reason should loose control.

The invention is not restricted to that described above and shown in the drawing but may be modified within the scope of the appended claims.

What I claim and desire to secure by Letters Patent is:

1. A revolving platorm for load material, said platform comprising a substantially flat structure having means for supporting the same on ground beneath the platform for rotation about the center of the platform, said platform having a recess extending inwardly of the platform from the periphery thereof for receiving the fork arms of a forklift truck while the form arms rest against the ground, said recess extending completely through said platform in a direction perpendicular to said platform and to the ground, said platform having a central portion dividing said recess into two legs at opposite sides thereof so that said fork arms may extend along said legs, respectively, to place a load on the platform or to remove a load from the platform, said central portion having a center bearing for the rotation of said platform on the ground, said platform having an interrupted circular periphery and having drive means engaging said periphery for rotating the platform, at least a portion of said drive means being in constant engagement with the periphery of said platform during said rotation.

2. A revolving platform as claimed in claim 1, wherein said means for supporting said platform on the ground comprises a plurality of rollers spaced about the periphery of the platform.

3. A revolving platform as claimed in claim 1, wherein said drive means comprises a pair of drive wheels engaging the periphery of the platform and spaced apart by a peripheral distance greater than the peripheral extent of said recess.

4. A revolving platform as claimed in claim 3, wherein said drive means is situated substantially entirely below the upper, loading plane of the platform.

5. A revolving platform as claimed in claim 1, wherein said platform has a pair of parallel rollers extending transversely of the recess for supporting a load on the platform, one roller being situated at one side of the center of the platform transverse to said central portion and the other roller being situated at the opposite side of the center, the latter roller comprising two parts situated at opposite sides of the recess.

6. A revolving platform as claimed in claim 5, wherein one of said rollers has means for driving the same in response to the rotation of the platform.

* * * * *